US010048646B2

(12) United States Patent
Suzuki et al.

(10) Patent No.: US 10,048,646 B2
(45) Date of Patent: Aug. 14, 2018

(54) IMAGE FORMING APPARATUS WITH FRAME BODY AND DETACHABLE CARTRIDGE WITH INTEGRATED PHOTOSENSITIVE DRUM

(71) Applicant: CANON KABUSHIKI KAISHA, Tokyo (JP)

(72) Inventors: Akira Suzuki, Naka-gun (JP); Hiroomi Matsuzaki, Mishima (JP); Kazunori Suzuki, Niiza (JP); Toshiteru Yamasaki, Yokohama (JP); Shigeo Miyabe, Yokohama (JP); Takahito Ueno, Mishima (JP); Shogo Satomura, Kawasaki (JP); Masatomi Yoshida, Kawasaki (JP); Nobuharu Hoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/319,057

(22) PCT Filed: Jun. 12, 2015

(86) PCT No.: PCT/JP2015/002952
§ 371 (c)(1),
(2) Date: Dec. 15, 2016

(87) PCT Pub. No.: WO2015/194144
PCT Pub. Date: Dec. 23, 2015

(65) Prior Publication Data

US 2018/0046136 A1 Feb. 15, 2018

(30) Foreign Application Priority Data

Jun. 17, 2014 (JP) ..... 2014-124748
May 8, 2015 (JP) ..... 2015-095772

(51) Int. Cl.
*G03G 21/00* (2006.01)
*G03G 21/18* (2006.01)
*G03G 15/08* (2006.01)

(52) U.S. Cl.
CPC ..... *G03G 21/1814* (2013.01); *G03G 15/0812* (2013.01); *G03G 21/0029* (2013.01); *G03G 2221/1606* (2013.01); *G03G 2221/18* (2013.01)

(58) Field of Classification Search
CPC ..... G03G 15/0812; G03G 21/0029; G03G 21/1814
(Continued)

(56) References Cited

U.S. PATENT DOCUMENTS 4,984,326 A * 1/1991 Horie et al. ..... G03G 15/0812 399/351
6,356,730 B1 * 3/2002 Nonaka ..... G03G 15/0812 399/251
2014/0133893 A1 5/2014 Ushikubo

FOREIGN PATENT DOCUMENTS

EP 2216691 A1 8/2010
JP 11-282251 A 10/1999
(Continued)

*Primary Examiner* — William J Royer
(74) *Attorney, Agent, or Firm* — Canon U.S.A., Inc. IP Division

(57) ABSTRACT

A structure includes a rotatable rotating member, a blade, a support member, and a frame body. The blade extends in an axial direction of the rotating member and is in contact with or disposed close to a surface of the rotating member. The support member supports the blade such that one end side of the blade projects toward the rotating member in a lateral direction that intersects the axial direction. The frame body is formed by insert molding in which resin is injected while
(Continued)

the support member is secured to a mold. The frame body clamps part of the support member so as to support the support member.

21 Claims, 14 Drawing Sheets

(58) Field of Classification Search
USPC ..... 399/111, 274, 284, 350, 351
See application file for complete search history.

(56) References Cited

FOREIGN PATENT DOCUMENTS

| | | |
|---|---|---|
| WO | 2006/098343 A1 | 9/2006 |
| WO | 2013/094167 A1 | 6/2013 |

* cited by examiner

IMAGE FORMING APPARATUS WITH FRAME BODY AND DETACHABLE CARTRIDGE WITH INTEGRATED PHOTOSENSITIVE DRUM

TECHNICAL FIELD

The present invention relates to an image forming apparatus, a cartridge that is attachable to and detachable from a main body of the image forming apparatus, and a frame body used for the cartridge of the image forming apparatus.

BACKGROUND ART

The present invention relates to an electrophotographic image forming apparatus and a process cartridge (referred to as "cartridge" hereafter) that is attachable to and detachable from the electrophotographic image forming apparatus. Here, the electrophotographic image forming apparatus (referred to as "image forming apparatus" hereafter) forms an image on a recording material (recording medium) by using an electrophotographic image forming process. Examples of the image forming apparatus include a printer (such as a laser beam printer or an LED printer), a copier, a facsimile machine, a word processor, a multi-function device (multi-function printer) that has the functions of these devices, and so forth.

A process cartridge method that allows the cartridge to be attached to and detached from an apparatus main body of the image forming apparatus is adopted for a related-art image forming apparatus that uses the photoelectric image forming process. With this process cartridge method, electrophotographic photosensitive drum (referred to as "photosensitive drum" hereafter) and process devices that perform operation on the photosensitive drum are integrated with one another in a cartridge, so that maintenance of the image forming apparatus can be simplified.

In such a cartridge, the difference in thermal expansion occurs between a developing blade support plate and a developing frame due to, for example, changes in ambient temperature. This difference causes a problem in that the developing blade is bent. Thus, the difference in contact pressure at which the developing blade is in contact with a developing roller occurs between a central portion and end portions in the longitudinal direction. This may cause density unevenness in an image. In order to address this, a structure has been proposed in which a developing blade is secured to a developing frame by a stepped screw using a wave washer (PTL 1).

CITATION LIST

Patent Literature

PTL 1: Japanese Patent Laid-Open No. 11-282251

SUMMARY OF INVENTION

Technical Problem

The present invention further develops the above-described related-art structure. With the above-described structure, the developing blade is secured to the developing frame by using the wave washer and the stepped screw. Thus, the number of components is increased and a production process becomes complex.

Furthermore, in the case where the blade and the roller are disposed with a gap therebetween, there may be the difference in thermal expansion between the blade support plate and the frame due to, for example, changes in ambient temperature. This may cause bending of the blade, and accordingly, change the size of the gap.

Accordingly, the present invention provides a structure that allows a blade to be easily secured to a frame body with a small number of components and that can suppress bending of the blade and the frame body caused by, for example, changes in ambient temperature. Thus, in the case where the blade and a rotating member are in contact with each other, the occurrence of the difference in a pressure contact at which the blade and the rotating member are in contact with each other in the axial direction of the rotating member is suppressed. In the case where the developing blade and the rotating member are disposed close to each other with a gap therebetween, changes in the size of the gap are reduced.

Solution to Problem

A cartridge according to the present invention includes a rotatable rotating member, a blade, a support member, and a frame body. The blade extends in an axial direction of the rotating member and is in contact with or disposed close to a surface of the rotating member. The support member supports the blade such that one end side of the blade projects toward the rotating member in a lateral direction that intersects the axial direction. The frame body is formed by insert molding in which resin is injected while the support member is secured to a mold. The frame body clamps part of the support member so as to support the support member.

A frame body according to the present invention is a frame body for a cartridge that is attachable to and detachable from an image forming apparatus. The frame body is formed by insert molding in which resin is injected while a reinforcing member is secured to a mold. Part of at least one surface of the reinforcing member is exposed.

Advantageous Effects of Invention

According to the present invention, a structure that allows a blade to be easily secured to a frame body with a small number of components and that suppresses bending of the blade and the frame body caused by, for example, changes in ambient temperature can be provided.

DESCRIPTION OF EMBODIMENTS

Next, further details of embodiments of the present invention will be described with reference to the drawings. In the following description, a longitudinal direction N refers to axial directions of a developer bearing member, that is, a developing roller, and an image bearing body, that is, a photosensitive drum.

First Embodiment

An Outline of an Entire Structure of an Image Forming Apparatus

The Entire Structure of the Image Forming Apparatus

Figure 2:
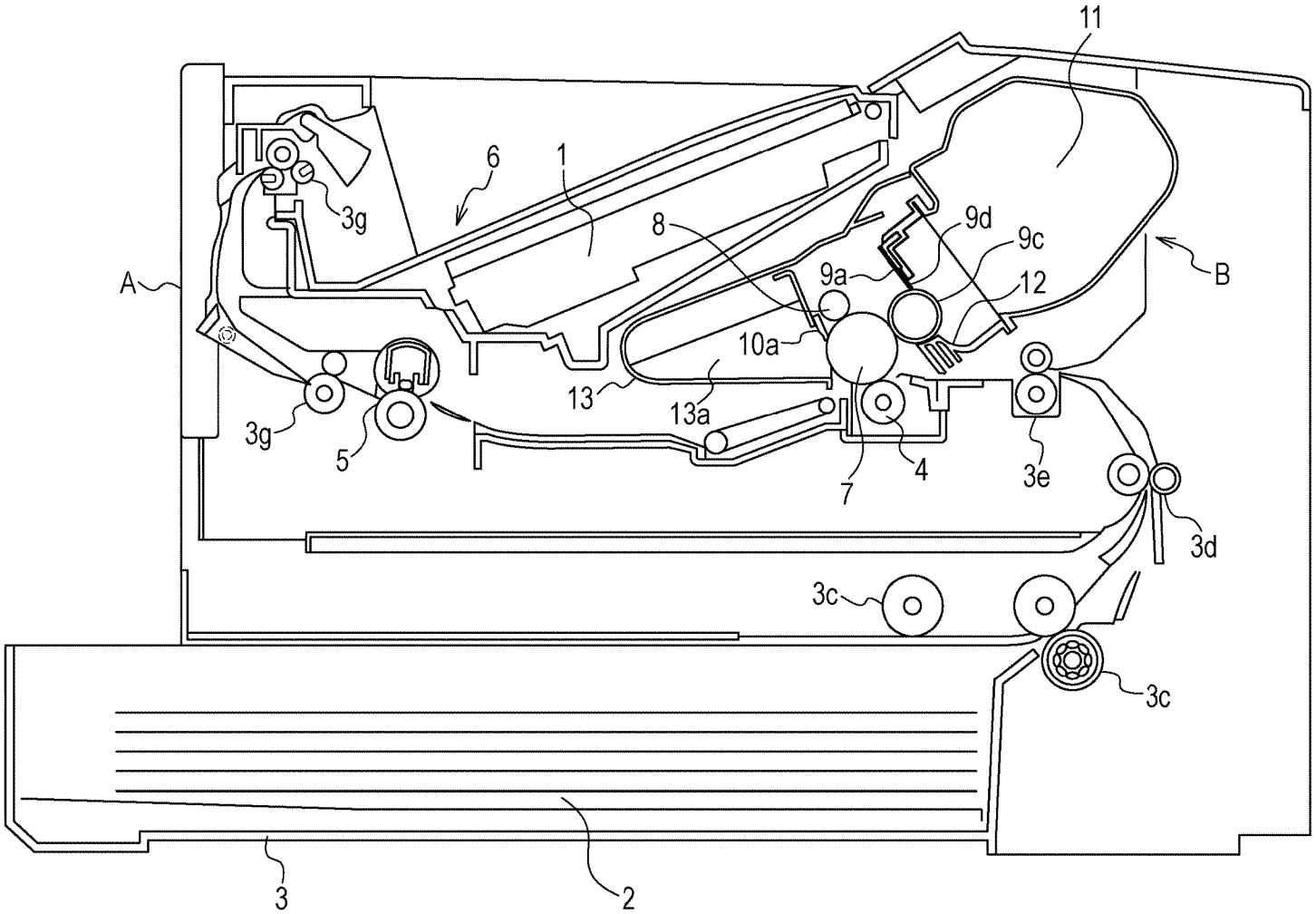
FIG. 2 is a sectional view of an image forming apparatus according to the first embodiment.

Initially, an outline of the entirety of a main body A of an image forming apparatus (referred to as a "main body" hereafter) is described with reference to FIG. 2. As illustrated in FIG. 2, a process cartridge B that is attachable to and detachable from the main body A is attached to the main body A. Here, the process cartridge B refers to a cartridge into which a photosensitive drum and at least a developing device serving as a process device that performs operation on the photosensitive drum are integrated and which is attachable to and detachable from the main body A of the image forming apparatus.

A rotatable photosensitive drum 7 and process devices disposed around the photosensitive drum 7 are integrally provided in the cartridge B. The process devices around the photosensitive drum 7 include, for example, a charging roller 8, a developing roller 9*c*, a developing blade 9*d*, and a cleaning blade 10*a*. The charging roller 8 uniformly charges a surface of the photosensitive drum 7. The developing blade 9*d* maintains the thickness of toner attracted to the developing roller 9*c* at a fixed thickness. The developing roller 9*c* develops a latent image formed on the photosensitive drum 7 with the toner so as to visualize the latent image. The cleaning blade 10*a* removes the toner remaining on the photosensitive drum 7 after a toner image formed on the photosensitive drum 7 has been transferred to a recording medium. Furthermore, a light exposure device 1 is disposed above the cartridge B. The photosensitive drum 7 is selectively exposed to light by using the light exposure device 1 in accordance with image information, so that the latent image is formed on the photosensitive drum 7.

A cassette 3 is attached in a lower portion of the main body A. The cassette 3 contains a recording medium 2 or recording media 2. The recording medium 2 or each of the recording media 2 is a sheet of, for example, paper. A recording medium conveying device is provided so that the recording media 2 is conveyed to an upper portion of the main body A through a transfer roller 4 and a fixing device 5. More specifically, a feed roller 3*c*, a conveying roller pair 3*d*, and a registration roller pair 3*e* are provided. The feed roller 3*c* separates one sheet after another from the recording media 2 in the cassette 3 and feeds each sheet. The conveying roller pair 3*d* conveys each of the recording media 2 having been fed thereto. The registration roller pair 3*e* synchronizes the latent image formed on the photosensitive drum 7 with the recording medium 2. Furthermore, the fixing device 5 that fixes the image formed on the recording medium 2 is provided.

When forming an image, the photosensitive drum 7 is rotated and uniformly charged by the charging roller 8. The uniformly charged photosensitive drum 7 is selectively exposed to light from the light exposure device 1. Thus, an electrostatic latent image is formed on the photosensitive drum 7. The latent image is developed by the developing roller 9*c*. Thus, a toner image is formed on the photosensitive drum 7. The registration roller pair 3*e* conveys the recording medium 2 to a nip between the photosensitive drum 7 and the transfer roller 4 such that the conveyance of the recording medium 2 is synchronized with this image formation. A voltage is applied to the transfer roller 4, thereby transferring the toner image onto the recording medium 2. Thus, an image is formed on the recording medium 2. The recording medium 2 on which the image has been formed is subjected to heat and pressure by the fixing device 5, so that the toner image is fixed. After that, the recording medium 2 is output to an output unit 6 by an output roller 3*g*.

Outline of the Entirety of the Cartridge

Figure 3:
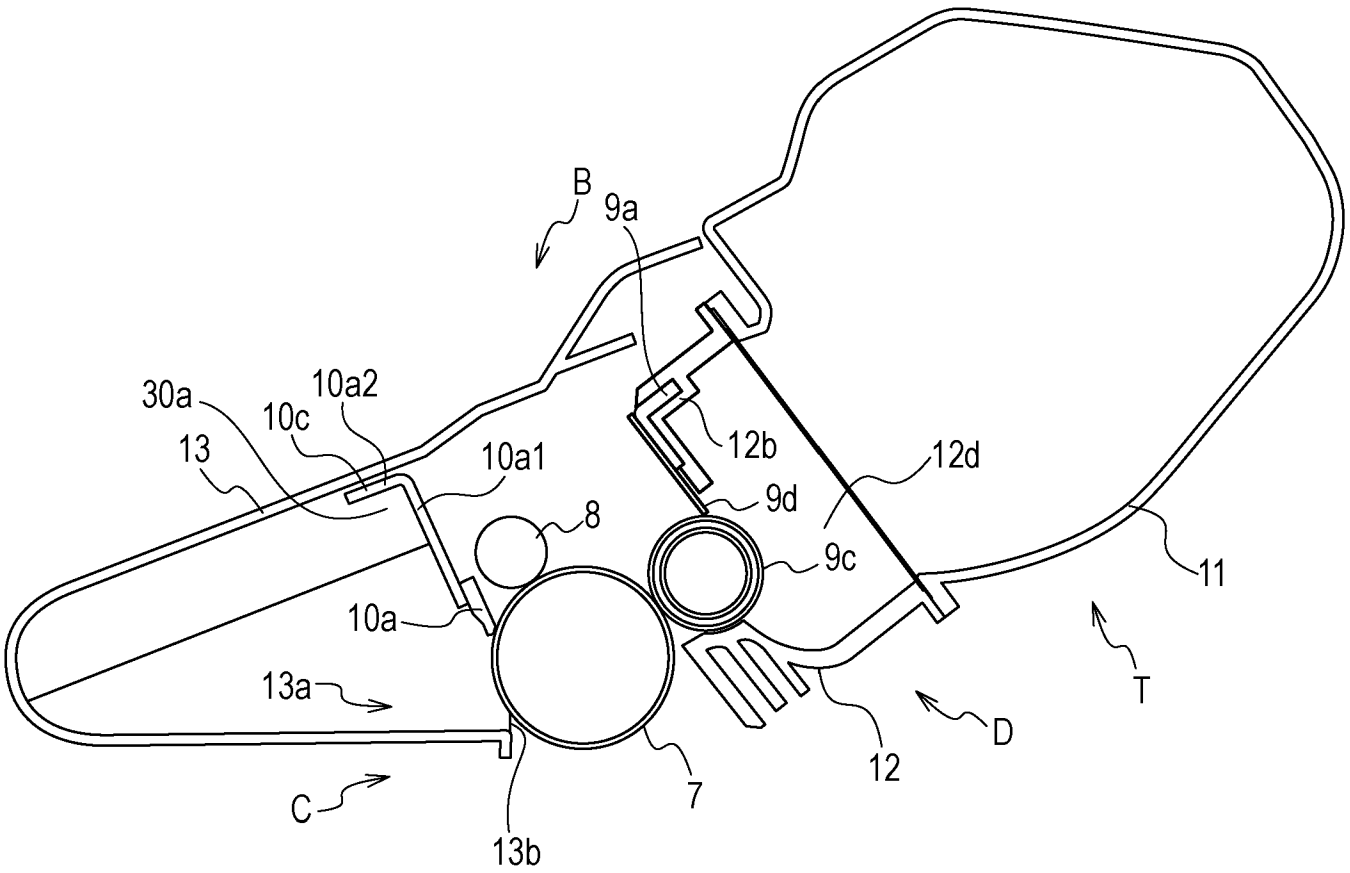
FIG. 3 is a sectional view of the cartridge according to the first embodiment.

Next, the outline of the entirety of the cartridge B is described with reference to FIG. 3. FIG. 3 is a sectional view of the cartridge B that contains the toner.

The cartridge B includes a cleaning unit C and a developer unit T. The cleaning unit C includes the photosensitive drum 7, the charging roller 8, the cleaning blade 10*a*, an anti-leakage sheet 13*b*, and a cleaning container 13 that forms a waste toner chamber 13*a*. The charging roller 8, the cleaning blade 10*a*, and the anti-leakage sheet 13*b* are disposed at a circumference of the photosensitive drum 7, which is a rotating member. The cleaning blade 10*a* is formed of an elastic member such as rubber and secured to the cleaning container 13 with a second support member 10*c*, which is supported at a first securing portion 30*a*, interposed between the cleaning blade 10*a* and the cleaning container 13. The cleaning blade 10*a* is in contact with the surface of the photosensitive drum 7 while the cleaning blade 10*a* is inclined in a rotational direction of the photosensitive drum 7 relative to a normal to the photosensitive drum 7. This cleaning blade 10*a* causes residual toner removed from the surface of the photosensitive drum 7 to drop into the waste toner chamber 13*a*. Furthermore, in order to prevent leakage of the waste toner from the waste toner chamber 13*a*, the anti-leakage sheet 13*b* is in contact with the photosensitive drum 7. The photosensitive drum 7 is rotated in accordance with image forming operation by transmitting a drive force from the main body A to the cleaning unit C. The charging roller 8 is rotatably attached to the cleaning unit C and pressed against the photosensitive drum 7, thereby being rotated by the photosensitive drum 7.

The developer unit T includes a developing unit D and a toner container 11. The toner container 11 contains the toner to be supplied to an opening 12*d* of a developing container 12 of the developing unit D. The developing unit D includes the developing roller 9*c*, the developing blade 9*d*, an anti-blowoff sheet, and the developing container 12. The developing roller 9*c* is in contact with the photosensitive drum 7, so that the developing roller 9*c* is rotated. The developing blade 9*d* regulates a toner layer on the developing roller 9*c*. The developing container 12 supports the developing roller 9*c*. The developing blade 9*d* and the anti-blowoff sheet are disposed at a circumference of the developing roller 9*c*, which is a rotating member. The developing blade 9*d* is formed of an elastic member such as rubber and secured to the developing container 12 with a first support member 9*a*, which is supported at a second securing portion 12*b*, interposed between the developing blade 9*d* and the developing container 12. According to the present embodiment, the developing blade 9*d* is disposed so as to be in contact with a surface of the developing roller 9*c*. Alternatively, the developing blade 9*d* may be disposed close to the developing roller 9*c* with a gap formed therebetween. Furthermore, in order to prevent leakage of the toner from the developing container 12, the anti-blowoff sheet is provided in the developing container 12 so as to be in contact with the developing roller 9*c*. The developer unit T is secured to the cleaning unit C such that the developing roller 9*c* faces the photosensitive drum 7.

Detailed Description of the Developer Unit

The developing unit D includes the developing roller 9*c*, the developing blade 9*d*, and the developing container 12. The developing roller 9*c* is in contact with the photosensitive drum 7, so that the developing roller 9*c* can be rotated. The developing blade 9*d* regulates the toner layer on the developing roller 9*c*. The developing container 12, which serves as a frame body, supports the developing roller 9*c*. Furthermore, in order to prevent leakage of the toner from the developing container 12, the anti-blowoff sheet is provided in the developing container 12 so as to be in contact with the developing roller 9*c*. The developing unit D is secured to the cleaning unit C such that the developing roller 9*c* faces the photosensitive drum 7. The toner container 11 that contains the toner supplied to the developing container 12 is connected to the developing unit D, thereby forming the developer unit T.

One end of the developing container 12 is connected to the toner container 11 and the other end of the developing container 12 has the opening 12*d* where the developing roller 9*c* is disposed. As illustrated in FIG. 3, the first support member 9*a* is provided on the other end side of the opening 12*d*. The developing blade 9*d* is secured to the first support member 9*a* in the longitudinal direction N. and the developing blade 9*d* extends in a lateral direction from one end side facing the opening to the rotating member side, that is, toward the developing roller 9*c*. The developing blade 9*d* is integrally formed with the first support member 9*a* or welded to the first support member 9*a* so as to be integrated with the first support member 9*a*.

Figure 1:
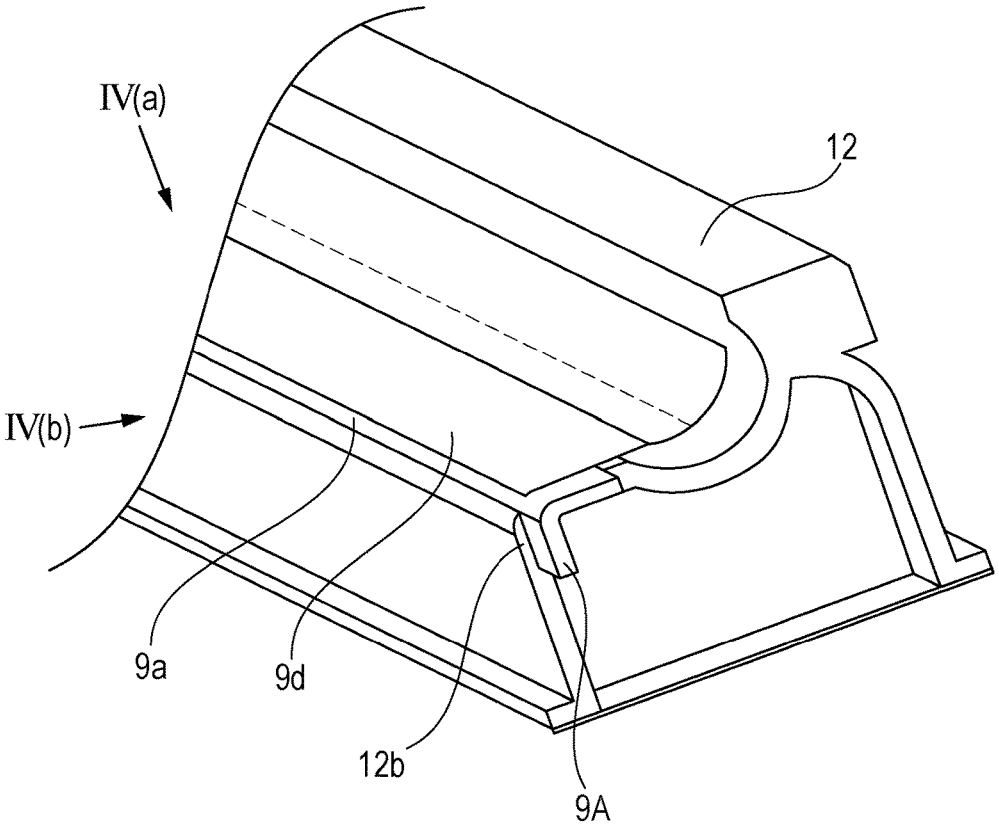
FIG. 1 is a perspective view of a cartridge according to a first embodiment.
Figure 4:
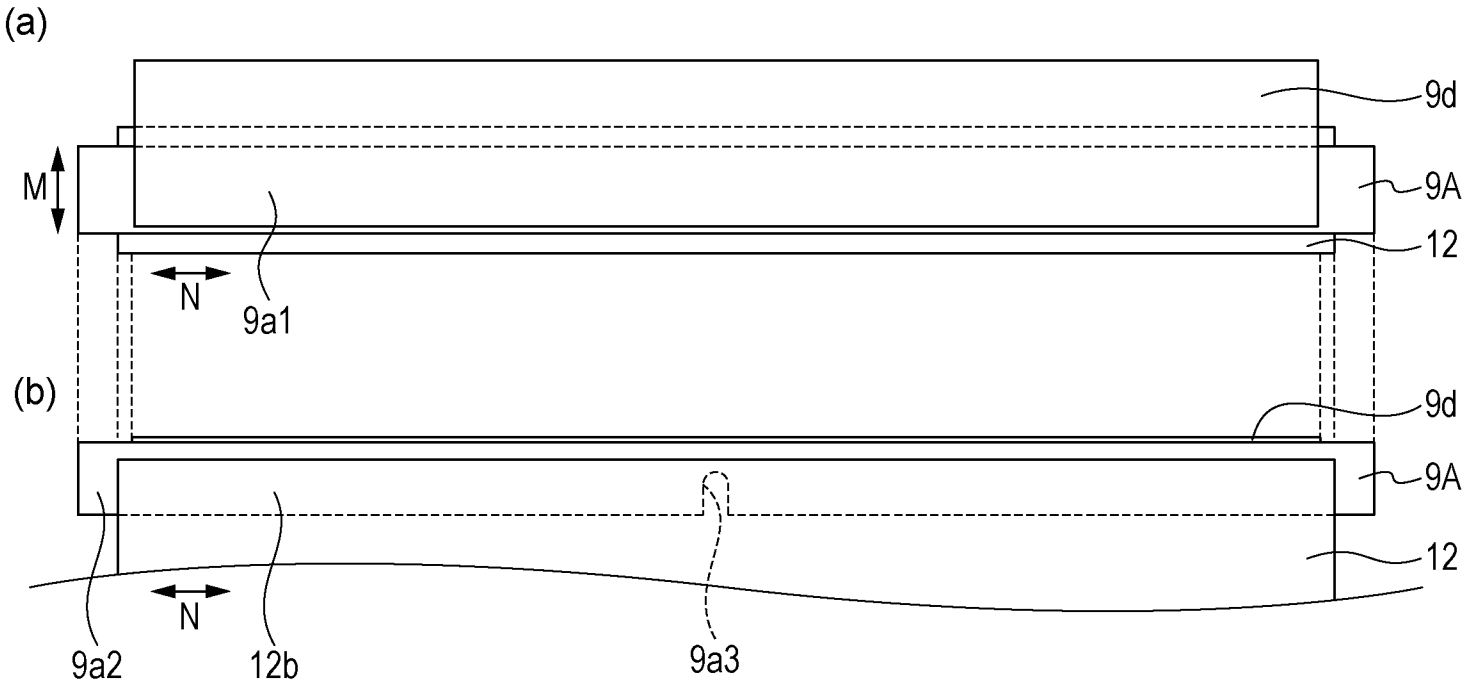
FIG. 4 is a plan view of the cartridge according to the first embodiment.

Referring to FIGS. 1 and 4, further details of the structure in which the first support member 9*a* and the developing blade 9*d* are attached to the developing container 12 are described. FIG. 1 is a perspective view of one end portion of the developing container 12. FIG. 4 includes views (a) and (b) illustrating the first support member 9*a*, the developing blade 9*d*, and a region close to the first support member 9*a* and the developing blade 9*d*. View (a) of FIG. 4 is a plan view of the developing blade 9*d* seen in the IV (a) direction indicated in FIG. 1 illustrating the developing blade 9*d* as an upper surface. View (b) of FIG. 4 is a plan view seen in the IV (b) direction indicated in FIG. 1 from the outer side of the developing container 12.

The first support member 9*a* is formed of a reinforcing member that extends in the longitudinal direction N. According to the present embodiment, a bent metal sheet that extends in the longitudinal direction N is used as the first support member 9*a*. More specifically, a steel material having an L-shaped section in a lateral direction M formed by a first plate portion 9*a*1 to which the developing blade 9*d* is secured and a second plate portion 9*a*2 is used as the first support member 9*a*. The first support member 9*a* is secured at the second securing portion 12*b* of the developing container 12. The developing blade 9*d* is secured to the first plate portion 9*a*1 such that the developing blade 9*d* projects from a side of the first plate portion 9*a*1 connected to the second plate portion 9*a*2 toward a side opposite to the side of the first plate portion 9*a*1 connected to the second plate portion 9*a*2. That is, part of the second plate portion 9*a*2 of the first support member 9*a* is embedded in the developing container 12 so as to be clamped between a main body of the developing container 12 and the second securing portion 12*b* of the developing container 12 in a thickness direction that intersects the longitudinal direction N of the second plate portion 9*a*2. Thus, the first support member 9*a* is supported by the developing container 12 and positioned relative to the developing container 12 in the lateral direction M. In this structure, an exposed portion 9A is formed so that least one of end portions of the first support member 9*a* in the longitudinal direction N is exposed from the developing container 12. According to the present embodiment, exposed portions 9A are formed so that both the ends of the second plate portion 9*a*2 of the first support member 9*a* in the longitudinal direction N are exposed from the developing container 12.

Furthermore, as illustrated in FIG. 4, a notch portion 9*a*3 can be provided in part of the first support member 9*a* embedded in the developing container 12. In this case, resin that forms the developing container 12 has flowed from the main body side or the second securing portion 12*b* side of the developing container 12 into the notch portion 9*a*3 provided in the second plate portion 9*a*2. This allows the first support member 9*a* to be positioned relative to the developing container 12 in the longitudinal direction N. The shape of the notch portion 9*a*3 may be any one of a circular hole, a long hole elongated in the lateral direction M, a recess, a shape having an opening at one end, and so forth. According to the present embodiment, the notch portion 9*a*3 is open at the side of the second plate portion 9*a*2 opposite to the side connected to the first plate portion 9*a*1. In this case, the width of the notch portion 9*a*3 can be equal to that of the opening or can decrease from the opening.

Bearing members that support a shaft of the developing roller 9*c* are provided on both ends of the developing container 12 in the longitudinal direction. Thus, the developing unit D has been formed.

Effect 1

With the above-described structure, part of the first support member 9*a* is clamped between the main body of the developing container 12 and the second securing portion 12*b* of the developing container 12. Thus, leakage of the developer to the outside of the developing container 12 can be prevented without using a seal member. In addition, the first support member 9*a* can be positioned relative to the developing container 12 in the lateral direction M.

Furthermore, the exposed portions 9A are formed so that the end portions of the first support member 9*a* in the longitudinal direction N are exposed from the developing container 12. Thus, expansion and contraction of the first support member 9*a* relative to the developing container 12 is tolerable.

In general, the coefficient of linear expansion (coefficient of thermal expansion), which represents the amount of expansion or contraction when subjected to heat, of metal is smaller than that of resin. Specifically, the coefficient of thermal expansion of a galvanized steel sheet used for the first support member 9*a* is 0.000015<1/° C.>. In contrast, the coefficient of thermal expansion of high impact polystyrene (HIPS) used for the developing container 12 is 0.000087<1/° C.>, which is significantly different from that of the galvanized steel sheet. Thus, when the first support member 9*a* and the developing container 12 are secured to each other at two or more positions in the longitudinal direction N in the related art, the cartridge B is deformed due to the difference in linear expansion (thermal expansion) between members included in the first support member 9*a* and the developing container 12. That is, when the temperature increases from room temperature, the developing container 12 side projects, and when the temperature decreases from room temperature, the first support member 9*a* side projects.

In contrast, according to the present embodiment, the developing container 12 can permit a movement of the first support member 9*a* in the longitudinal direction N while regulating a movement of the first support member 9*a* in the lateral direction. Accordingly, bending or deformation of the first support member 9*a*, the developing blade 9*d* secured to the first support member 9*a*, and the developing container 12 caused by changes in room temperature can be suppressed. That is, according to the present embodiment in which the developing blade 9*d* and the developing roller 9*c* are in contact with each other, the occurrence of the difference in contact pressure at which the developing blade 9*d* and the developing roller 9*c* are in contact with each other in the longitudinal direction N of the developing roller 9*c* can be suppressed. In the case where the developing blade 9*d* and the developing roller 9*c* are disposed close to each other with the gap therebetween, changes in the size of the gap can be reduced. As a result, the likelihood of being affected by heat can be easily reduced with a small number of components instead of increasing the number of components.

Furthermore, the notch portion 9*a*3 is provided in the part of the first support member 9*a* embedded in the developing container 12. The resin that forms the developing container 12 has flowed from the main body side or the second securing portion 12*b* side of the developing container 12 into the notch portion 9*a*3 of the first support member 9*a* so as to be engaged with the notch portion 9*a*3. As a result, the first support member 9*a* can be positioned relative to the developing container 12 in the longitudinal direction N.

Furthermore, in the structure according to the present embodiment, the first support member 9*a* is not screwed or bonded to the developing container 12, and the notch portion 9*a*3 provided in the first support member 9*a* is open to an end surface extending in the longitudinal direction N. Thus, an easily recyclable structure can be obtained.

A Method of Producing the Developing Unit 1

Figure 5A:
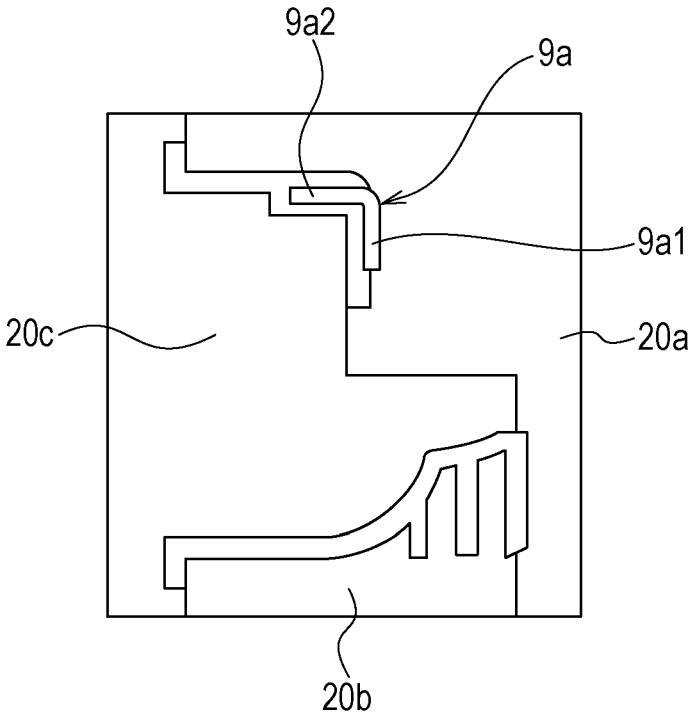
FIG. 5A illustrates a method of producing the cartridge according to the first embodiment.

A method of producing the above-described developing unit D is described below with reference to FIGS. 5A and 5B. As illustrated in FIG. 5A, the production method is described with an example of a method of forming in which the developing container 12 is integrally molded with the first support member 9*a* by using a mold 20 that includes a fixed part 20*a* and movable parts 20*b* and 20*c*. Initially, the first support member 9*a* is prepared and secured to the fixed part 20*a*. Then, the movable parts 20*b* and 20*c* are set in the fixed part 20*a*, and molten resin used to form the developing container 12 is injected into a space 23 having been formed. Thus, the developing container 12 is formed. More specifically, the developing container 12 is formed without embedding both the ends of the first support member 9*a* in the longitudinal direction N and the first plate portion 9*a*1 in the molten resin. Thus, the exposed portions 9A are provided at both the end portions of the first support member 9*a* in the longitudinal direction N. Meanwhile, part of the second plate portion 9*a*2 of the first support member 9*a* is secured so as to project into the space of the mold 20 when the molten resin used to form the developing container 12 is injected into the mold 20. Thus, the second plate portion 9*a*2 of the first support member 9*a* is embedded in the developing container 12. By performing insert molding as described above, the first support member 9*a* is secured to the developing container 12. The notch portion 9*a*3 can be provided in the part of the first support member 9*a* embedded in the developing container 12. Thus, the resin that forms the developing container 12 flows from the main body side or the second securing portion 12*b* side of the developing container 12 into the notch portion 9*a*3 of the second plate portion 9*a*2. As a result, the first support member 9*a* can be positioned relative to the developing container 12 in the longitudinal direction N.

The developing container 12 may be formed of any type of thermosetting resin or thermoplastic resin that can be processed by injection molding. For example, a styrenic resin composition that contains at least styrenic resin as base material resin and a rubber-like polymer may be used. Although examples of the styrenic resin contained in the styrenic resin composition include, for example, polystyrene and acrylonitrile butadiene styrene (ABS), use of polystyrene is desirable. Examples of the rubber-like polymer contained in the styrenic resin compound include, for example, polybutadiene, a styrene-butadiene copolymer, polyisoprene, a butadiene-isoprene copolymer, natural rubber, an ethylene-propylene copolymer, and a combination of these. As the rubber-like polymer contained in the styrenic resin compound, use of a high styrene-butadiene copolymer is particularly desirable. A styrenic resin compound that contains styrenic resin and a rubber-like polymer may be referred to as HIPS, which is a rubber-modified styrenic material. HIPS is a resin composition made by mixing polystyrene (PS) that is cheap and has good fluidity with a rubber-like polymer (including a rubber-like copolymer) so as to have improved shock resistance. Thus, use of the HIPS is desirable. Thus, the developing container 12 according to the present embodiment is formed of HIPS.

Figure 5B:
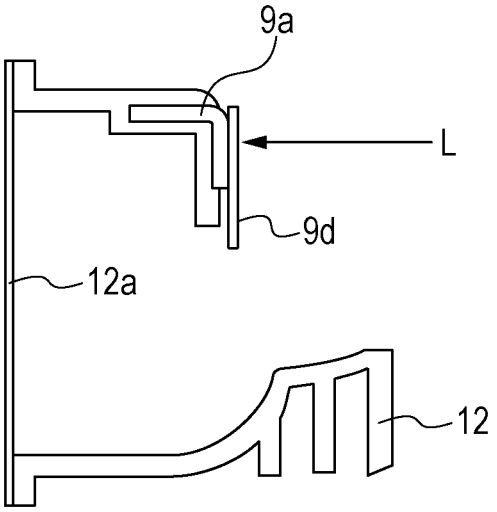
FIG. 5B illustrates the method of producing the cartridge according to the first embodiment.

As illustrated in FIG. 5B, after the developing blade 9*d* formed of, for example, stainless steel, has been disposed on the first support member 9*a* secure to the developing container 12, a laser light L is radiated so as to secured the developing blade 9*d* to the first support member 9*a*. A developing container lid 12*a* is joined to the developing container 12 by, for example, ultrasonic welding. At last, the shaft of the developing roller 9*c* is supported by the bearing members (not illustrated) provided at both the ends of the developing container 12 in the longitudinal direction N such that the tip end of the developing blade 9*d* is disposed on the developing roller 9*c*, which is the rotating member. The developing unit D is thus formed. Alternatively, bearing portions may be provided in the developing container 12, so that both the ends of the shaft of the developing roller 9*c* in the longitudinal direction N are supported by the bearing portions of the developing container 12.

Effect 2

With the structure according to the above-described embodiment, leakage of the developer to the outside of the developing container 12 can be prevented without using the seal member between the first support member 9*a* and the main body of the developing container 12. Thus, a production process can be further simplified. Furthermore, the movement of the first support member 9*a* relative to the developing container 12 is regulated in the lateral direction and permitted in the longitudinal direction N by the exposed portions 9A in the developing unit D produced by the method according to the present embodiment. Accordingly, bending or deformation of the first support member 9*a*, the developing blade 9*d* secured to the first support member 9*a*, and the developing container 12 caused by changes in room temperature can be suppressed. That is, according to the present embodiment in which the developing blade 9*d* and the developing roller 9*c* are in contact with each other, the occurrence of the difference in contact pressure at which the developing blade 9*d* and the developing roller 9*c* are in contact with each other in the longitudinal direction N of the developing roller 9*c* can be suppressed. In the case where the developing blade 9*d* and the developing roller 9*c* are disposed close to each other with the gap therebetween, changes in the size of the gap can be reduced. As a result, the likelihood of being affected by heat can be easily reduced with a small number of components instead of increasing the number of components.

Furthermore, the notch portion 9*a*3 is provided in the part of the first support member 9*a* embedded in the developing container 12. The resin that forms the developing container 12 has flowed from the main body side or the securing portion 12*b* side of the developing container 12 into the notch portion 9*a*3 of the first support member 9*a*. As a result, the first support member 9*a* can be positioned relative to the developing container 12 in the longitudinal direction N. Furthermore, the first support member 9*a* is not screwed or bonded to the developing container 12, and the notch portion 9*a*3 provided in the first support member 9*a* is open to the end surface extending in the longitudinal direction N. Thus, in addition to making production easier, an easily recyclable structure can be obtained.

Second Embodiment

Figure 6:
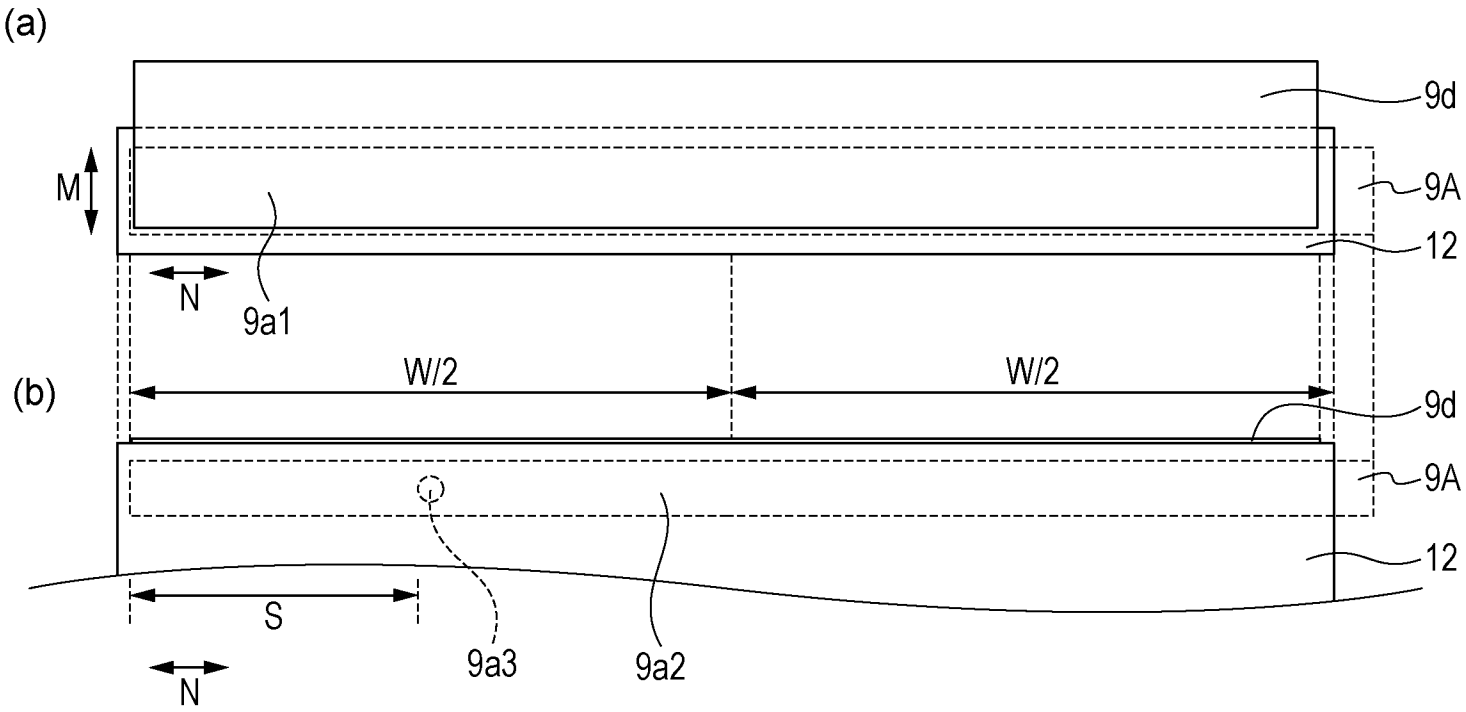
FIG. 6 is a plan view of a cartridge according to a second embodiment.

According to the first embodiment, the exposed portions 9A at both the ends of the first support member 9*a* in the longitudinal direction N and the first plate portion 9*al* are not embedded in the molten resin used to form the developing container 12. However, this is not limiting. As illustrated in FIG. 6, a structure is possible in which one of the end portions of the first support member 9*a* in the longitudinal direction N is not embedded in the molten resin used to form the developing container 12. In this case, a cushion member may be disposed at the one of the end portions of the first support member 9*a* so that the first support member 9*a*, the cushion member, and the developing container 12 are sequentially arranged in the longitudinal direction N. Furthermore, not only the second plate portion 9*a*2 but also the first plate portion 9*a* of the first support member 9*a* may be embedded in the molten resin used to form the developing container 12. In this case, the developing blade 9*d* is secured to the first plate portion 9*a*1 with the developing container 12 interposed therebetween. The notch portion 9*a*3 may be provided also according to the present embodiment. In this case, the notch portion 9*a*3 may be provided in the second plate portion 9*a*2 or in the part of the first support member 9*a* embedded in the developing container 12 such as the first plate portion 9*a*1 instead of the second plate portion 9*a*2. The notch portion 9*a*3 is formed such that a shortest distance S between an end portion of the notch portion 9*a*3 and the other end portion of the first support member 9*a* embedded in the molten resin in the longitudinal direction N is less than half a length W, by which the first support member 9*a* is embedded in the molten resin. That is, the distance S is less than half a length that is calculated by subtracting the length of the exposed portion 9A from the length of the first support member 9*a*. According to the present embodiment, a circular hole serving as the notch portion 9*a*3 is provided at a position one fourth of the length W, by which the first support member 9*a* is embedded in the molten resin, away from the other end portion of the first support member 9*a*. FIG. 6 includes views (a) and (b) illustrating the first support member 9*a*, the developing blade 9*d*, and a region close to the first support member 9*a* and the developing blade 9*d*. View (a) of FIG. 6 is a plan view of the developing blade 9*d* illustrating the developing blade 9*d* as an upper surface. View (b) of FIG. 6 is a plan view seen from the outer side of the developing container 12.

With the structure according to the present embodiment, as is the case with the first embodiment, the developing container 12 can permit the movement of the first support member 9*a* in the longitudinal direction N while regulating the movement of the first support member 9*a* in the lateral direction. This can suppress deformation of the process cartridge B caused by the difference in linear expansion (thermal expansion) between members included in the developing container 12 and the first support member 9*a*. That is, bending or deformation of the first support member 9*a*, the developing blade 9*d* secured to the first support member 9*a*, and the developing container 12 caused by changes in room temperature can be suppressed. According to the present embodiment in which the developing blade 9*d* and the developing roller 9*c* are in contact with each other, the occurrence of the difference in contact pressure at which the developing blade 9*d* and the developing roller 9*c* are in contact with each other in the longitudinal direction N of the developing roller 9*c* can be suppressed. In the case where the developing blade 9*d* and the developing roller 9*c* are disposed close to each other with the gap therebetween, changes in the size of the gap can be reduced. As a result, the likelihood of being affected by heat can be easily reduced with a small number of components instead of increasing the number of components.

In the related art, when the first support member 9*a* that reinforces the developing container 12 and the developing blade 9*d* are disposed in the developing container 12, the developing blade 9*d* cannot be secured to the developing container 12 with good positional accuracy due to errors in steps of assembling the members. However, according to the present embodiment, the developing blade 9*d* is directly secured to the developing container 12. Thus, the developing blade 9*d* can be secured to the developing container 12 with good positional accuracy.

Furthermore, the notch portion 9*a*3 is provided in the part of the first support member 9*a* embedded in the developing container 12. The resin that forms the developing container 12 has flowed from the main body side or the second securing portion 12*b* side of the developing container 12 into the notch portion 9*a*3. This allows the first support member 9*a* to be positioned relative to the developing container 12 in the longitudinal direction N.

The invention according to the present embodiment can be produced in a method similar to that of the first embodiment, and the effects similar to those in the first embodiment can be obtained.

Third Embodiment

Figure 7:
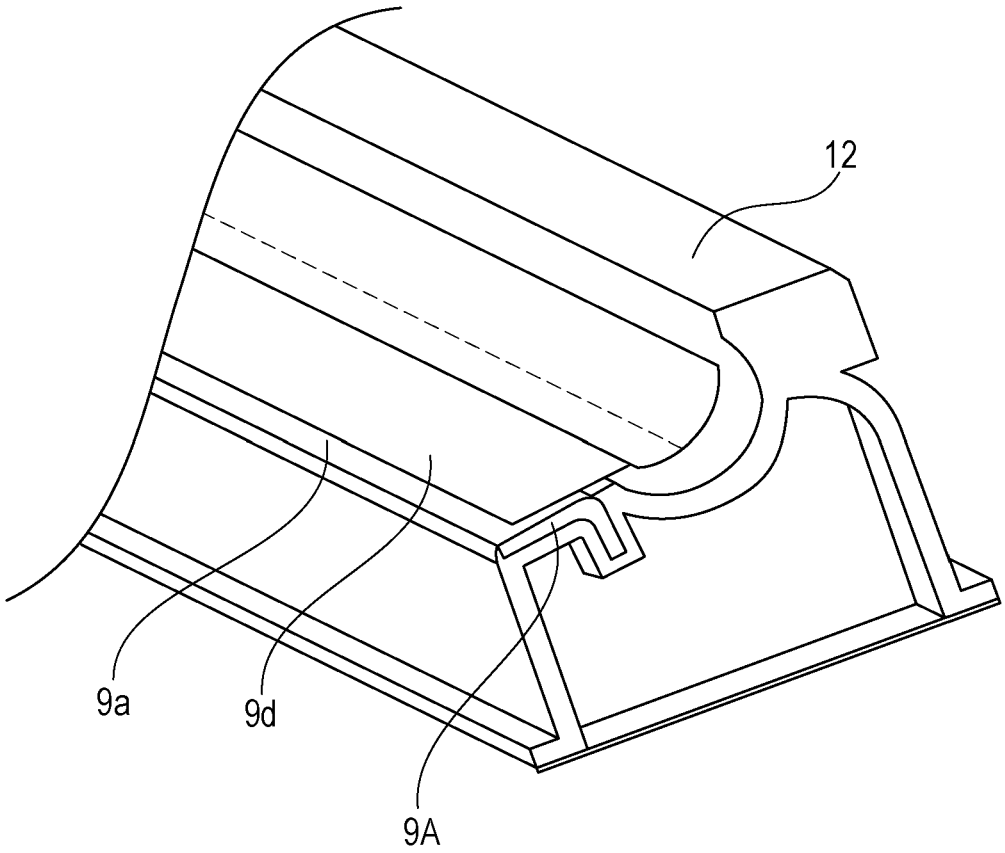
FIG. 7 is a perspective view of a cartridge according to a third embodiment.

According to the first embodiment, the first support member 9*a* is secured at the second securing portion 12*b* of the developing container 12, and the developing blade 9*d* is secured to the first plate portion 9*a*1 such that the developing blade 9*d* projects from the side of the first plate portion 9*a*1 connected to the second plate portion 9*a*2 toward the side opposite to the side of the first plate portion 9*a*1 connected to the second plate portion 9*a*2. However, this is not limiting. As illustrated in FIG. 7, the developing blade 9*d* may be secured to the first plate portion 9*a*1 of the first support member 9*a* such that the developing blade 9*d* projects from the side opposite to the side where the first plate portion 9*a*1 and the second plate portion 9*a*2 of the first support member 9*a* are connected to each other toward the side where the first plate portion 9*a*1 and the second plate portion 9*a*2 are connected to each other. Also, as illustrated in FIG. 7, it is sufficient that the exposed portion 9A may be formed by exposing an end surface in the longitudinal direction N. The end portion or the end portions of the first support member 9*a* do not necessarily project in the longitudinal direction N as described in the first or second embodiment. With this structure, the effects similar to those of the first embodiment can be obtained.

The invention according to the present embodiment can be produced in a method similar to that of the first embodiment, and the effects similar to those in the first embodiment can be obtained.

Figure 8:
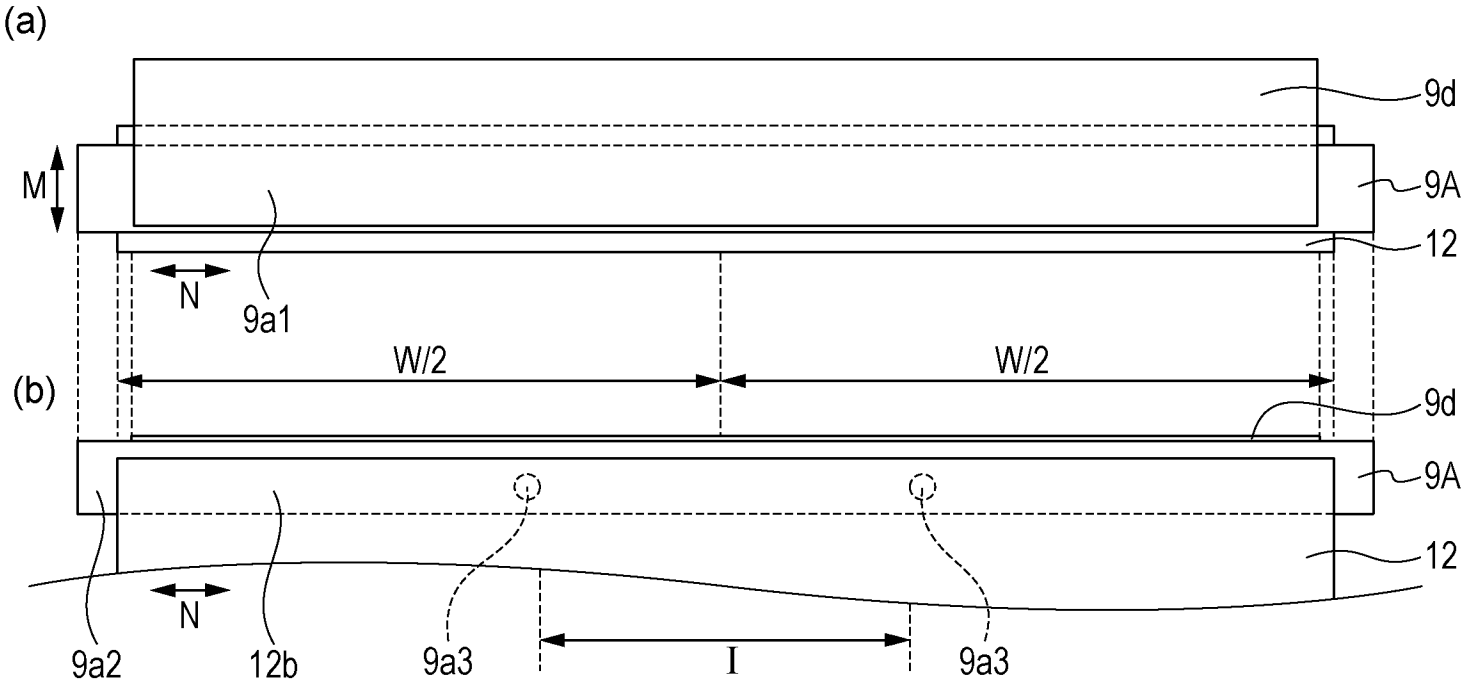
FIG. 8 is a plan view of a cartridge according to a variant.

According to the first to third embodiments, a single notch portion 9*a*3 is provided. However, this is not limiting. A plurality of notch portions 9*a*3 as illustrated in FIGS. 8(*a*) and 8(*b*) may be provided. In this case, a shortest interval I between the end portions of the notch portions 9*a*3 is less than half the length W, by which the first support member 9*a* is embedded in the molten resin, that is, the length calculated by subtracting the length of the exposed portions 9A from the length of the first support member 9*a*. FIGS. 8(*a*) and 8(*b*) includes views (a) and (b) illustrating the first support member 9*a*, the developing blade 9*d*, and a region close to the first support member 9*a* and the developing blade 9*d*. View (a) of FIG. 8 is a plan view of the developing blade 9*d* illustrating the developing blade 9*d* as an upper surface. View (b) of FIG. 8 is a plan view seen from the outer side of the developing container 12. Referring to FIG. 8, the distance I between the notch portions 9*a*3 is one third of the length W, by which the first support member 9*a* is embedded in the molten resin, and each of the notch portions 9*a*3 has a circular shape.

Although a steel material having an L-shaped section in the lateral direction M is used as the first support member 9*a*, the first support member 9*a* is not limited to this. Any reinforcing member may be used as the first support member 9*a*. For example, a plate-shaped or rod-shaped steel material may be used as the first support member 9*a*.

Although the developing blade 9*d* is secured to the first support member 9*a* after the first support member 9*a* has been integrated with the developing container 12, this is not limiting. For example, the first support member 9*a* to which the developing blade 9*d* has been secured in advance may be used. Also, the first support member 9*a* and the developing blade 9*d* may be integrated with each other.

Fourth Embodiment

According to the first to third embodiments, the present invention is applied to the structure with which the developing blade 9*d* is secured in the developing unit D. In a fourth embodiment, the present invention is applied to a structure with which the support member that supports the cleaning blade is secured in the cleaning unit. The structure according to the fourth embodiment is similar to the entire structure of the image forming apparatus and the outline of the entirety of the cartridge of the first embodiment. Thus, the difference between the first embodiment and the fourth embodiment is mainly described below.

Detailed Description of the Cleaning Unit

The cleaning container 13 has an opening disposed such that the photosensitive drum 7 faces the opening. As illustrated in FIG. 3, the second support member 10*c* is provided in the opening. The cleaning blade 10*a* is secured to the second support member 10*c* in the longitudinal direction N, and the cleaning blade 10*a* extends in a lateral direction from one end side facing the opening to the rotating member side, that is, toward the photosensitive drum 7. The cleaning blade 10*a* is integrally formed with the second support member 10*c* or welded to the second support member 10*c* so as to be integrated with the second support member 10*c*.

The second support member 10*c* is formed of a reinforcing member that extends in the longitudinal direction N. According to the present embodiment, a bent metal sheet that extends in the longitudinal direction N is used as the second support member 10*c*. That is, a steel material having an L-shaped section in the lateral direction M formed by a third plate portion 10*a*1 to which the cleaning blade 10*a* is secured and a fourth plate portion 10*a*2 is used as the second support member 10*c*. The second support member 10*c* is secured at a securing portion of the cleaning container 13. The cleaning blade 10*a* is secured to the third plate portion 10*a*1 such that the cleaning blade 10*a* projects from a side of the third plate portion 10*a*1 connected to the fourth plate portion 10*a*2 toward a side opposite to the side of the third plate portion 10*a*1 connected to the fourth plate portion 10*a*2. More specifically, part of the fourth plate portion 10*a*2 of the second support member 10*c* is embedded in the cleaning container 13 so as to be clamped between a main body of the cleaning container 13 and the securing portion of the cleaning container 13 in a thickness direction that intersects the longitudinal direction N of the fourth plate portion 10*a*2. Thus, the second support member 10*c* is supported by the cleaning container 13 and positioned relative to the cleaning container 13 in the lateral direction M. In this structure, exposed portions are formed so that end portions of the second support member 10*c* in the longitudinal direction N are exposed from the cleaning container 13. According to the present embodiment, both ends of the second support member 10*c* in the longitudinal direction N are exposed from the cleaning container 13.

Furthermore, a notch portion can be provided in part of the second support member 10*c* embedded in the cleaning container 13. In this case, resin that forms the cleaning container 13 has flowed from the main body side or the securing portion side of the cleaning container 13 into the notch portion of the fourth plate portion 10*a*2. This allows the second support member 10*c* to be positioned relative to the cleaning container 13 in the longitudinal direction N. The shape of the notch portion may be any one of a circular hole, a long hole elongated in the lateral direction M, a recess, a shape having an opening at one end, and so forth. According to the present embodiment, the notch portion is open at the side of the fourth plate portion 10*a*2 opposite to the side connected to the third plate portion 10*a*1. In this case, the width of the notch portion can be equal to that of the opening or can decrease from the opening.

Bearing members that support a shaft of the photosensitive drum 7 are provided on both ends of the cleaning container 13 in the longitudinal direction. Thus, the cleaning unit C has been formed. Alternatively, bearing portions may be provided in the cleaning container 13, so that both the ends of the shaft of the photosensitive drum 7 in the longitudinal direction N are supported by the bearing portions of the cleaning container 13.

Effect 3

With the above-described structure, part of the second support member 10*c* is clamped between the main body of the cleaning container 13 and the securing portion of the cleaning container 13. Thus, leakage of the developer to the outside of the cleaning container 13 can be prevented without using a seal member. This also allows the second support member 10*c* to be positioned relative to the cleaning container 13 in the lateral direction M.

Furthermore, the exposed portions are formed so that the end portions of the second support member 10*c* in the longitudinal direction N are exposed from the cleaning container 13. Thus, the cleaning container 13 can permit a movement of the second support member 10*c* in the longitudinal direction N while regulating a movement of the second support member 10*c* in the lateral direction. That is, expansion and contraction of the second support member 10*c* relative to the cleaning container 13 is tolerable. Accordingly, bending or deformation of the second support member 10*c*, the cleaning blade 10*a* secured to the second support member 10*c*, and the cleaning container 13 caused by changes in room temperature can be suppressed. According to the present embodiment in which the cleaning blade 10*a* and the photosensitive drum 7 are in contact with each other, the occurrence of the difference in contact pressure at which the cleaning blade 10*a* and the photosensitive drum 7 are in contact with each other in the longitudinal direction N of the photosensitive drum 7 can be suppressed. As a result, the likelihood of being affected by heat can be easily reduced with a small number of components instead of increasing the number of components.

Furthermore, the notch portion is provided in the part of the second support member 10*c* embedded in the cleaning container 13. The resin that forms the cleaning container 13 has flowed from the main body side or the securing portion side of the cleaning container 13 into the notch portion of the second support member 10*c*. As a result, the second support member 10*c* can be positioned relative to the cleaning container 13 in the longitudinal direction N.

Furthermore, the second support member 10*c* is not screwed or bonded to the cleaning container 13, and the notch portion provided in the second support member 10*c* is open to an end surface extending in the longitudinal direction N. Thus, an easily recyclable structure can be obtained.

A Method of Producing the Cleaning Unit

A method of producing the above-described cleaning unit C is described below. As is the case with the first embodiment, the production method is described with an example of a method of forming in which the cleaning container 13 is integrally molded with the second support member 10*c* by using a mold. Initially, the second support member 10*c* in which the cleaning blade 10*a* has been formed at an end portion of the third plate portion 10*a*1 is prepared and set in the mold. After that, molten resin used to form the cleaning container 13 is injected into the mold, thereby forming the cleaning container 13. More specifically, the cleaning container 13 is formed without embedding both the ends of the second support member 10*c* in the longitudinal direction N and the cleaning blade 10*a* in the molten resin used to form the cleaning container 13. Thus, the exposed portions are provided at both the end portions of the second support member 10*c* in the longitudinal direction N. Meanwhile, part of the fourth plate portion 10*a*2 of the second support member 10*c* is secured so as to project into a space of the mold when the molten resin used to form the cleaning container 13 is injected into the mold. Thus, the fourth plate portion 10*a*2 of the second support member 10*c* is embedded in the cleaning container 13. By performing insert molding as described above, the second support member 10*c* is secured to the cleaning container 13. The notch portion can be provided in the part of the second support member 10*c* embedded in the cleaning container 13. Thus, the resin that forms the cleaning container 13 flows from the main body side or the securing portion side of the cleaning container 13 into the notch of the fourth plate portion 10*a*2. As a result, the second support member 10*c* can be positioned relative to the cleaning container 13 in the longitudinal direction N.

The cleaning container 13 may be formed of any type of thermosetting resin or thermoplastic resin that can be processed by injection molding. For example, a styrenic resin composition that contains at least styrenic resin as base material resin and a rubber-like polymer may be used. Although examples of the styrenic resin contained in the styrenic resin composition include, for example, polystyrene and acrylonitrile butadiene styrene (ABS), use of polystyrene is desirable. Examples of the rubber-like polymer contained in the styrenic resin compound include, for example, polybutadiene, a styrene-butadiene copolymer, polyisoprene, a butadiene-isoprene copolymer, natural rubber, an ethylene-propylene copolymer, and a combination of these. As the rubber-like polymer contained in the styrenic resin compound, use of a high styrene-butadiene copolymer is particularly desirable. A styrenic resin compound that contains styrenic resin and a rubber-like polymer may be referred to as HIPS, which is a rubber-modified styrenic material. HIPS is a resin composition made by mixing polystyrene (PS) that is cheap and has good fluidity with a rubber-like polymer (including a rubber-like copolymer) so as to have improved shock resistance. Thus, use of the HIPS is desirable. Thus, the cleaning container 13 according to the present embodiment is formed of HIPS.

The shaft of the photosensitive drum 7 is supported by the bearing members (not illustrated) provided at both the ends of the cleaning container 13 in the longitudinal direction N such that the tip end of the cleaning blade 10*a* is disposed on the photosensitive drum 7 that is the rotating member. The cleaning unit C is thus formed.

Effect 4

With the structure according to the above-described embodiment, leakage of the developer to the outside of the cleaning container 13 can be prevented without using the seal member between the second support member 10*c* and main body of the cleaning container 13. Thus, a production process can be further simplified. Furthermore, the movement of the second support member 10*c* relative to the cleaning container 13 is regulated in the lateral direction and permitted in the longitudinal direction N by the exposed portion in the cleaning unit C produced by the method according to the present embodiment. Accordingly, bending or deformation of the second support member 10*c*, the cleaning blade 10*a* secured to the second support member 10*c*, and the cleaning container 13 caused by changes in room temperature can be suppressed. According to the present embodiment in which the cleaning blade 10*a* and the photosensitive drum 7 are in contact with each other, the occurrence of the difference in contact pressure at which the cleaning blade 10*a* and the photosensitive drum 7 are in contact with each other in the longitudinal direction N of the photosensitive drum 7 can be suppressed. As a result, the likelihood of being affected by heat can be easily reduced with a small number of components instead of increasing the number of components.

Furthermore, the notch portion is provided in the part of the second support member 10*c* embedded in the cleaning container 13. The resin that forms the cleaning container 13 has flowed from the main body side or the securing portion side of the cleaning container 13 into the notch portion of the second support member 10*c*. As a result, the second support member 10*c* can be positioned relative to the cleaning container 13 in the longitudinal direction N.

Furthermore, the second support member 10*c* is not screwed or bonded to the cleaning container 13, and the notch portion provided in the second support member 10*c* is open to an end surface extending in the longitudinal direction N. Thus, in addition to making production easier, an easily recyclable structure can be obtained.

Although the second support member 10*c* to which the cleaning blade 10*a* is secured in advance is used in the above-described embodiment, this is not limiting. For example, as is the case with the first embodiment, the cleaning blade 10*a* may be secured to the second support member 10*c* after the second support member 10*c* is integrated with the cleaning container 13. Alternatively, the cleaning blade 10*a* may be integrated with the second support member 10*c*. Also in the structure according to the present embodiment, changes similar to those of the second and third embodiments made to the first embodiment may be made to the present embodiment, and the effects similar to those produced by the second and third embodiments can be obtained.

Fifth Embodiment

According to the first to third embodiments, the support member 9*a* is secured to the fixed part 20*a*, the movable parts 20*b* and 20*c* are set in the fixed part 20*a*, and then the molten resin used to form the developing container 12 is injected into a space having been formed. Thus, the developing container 12 is formed. At this time, in order to secure the first support member 9*a* to the fixed part 20*a*, both the end portions of the first support member 9*a* in the longitudinal direction are supported. However, the position of the first support member 9*a* relative to the fixed part 20*a* may be deviated by a pressure of the resin applied when the molten resin used to form the developing container 12 is injected. Thus, as a fifth embodiment, the developing unit with which the deviation of the position of the first support member 9*a* relative to the fixed part 20*a* is suppressed and a method of producing this developing unit will be described below. The structure according to the fifth embodiment is also similar to the entire structure of the image forming apparatus and the outline of the entirety of the cartridge of the first embodiment. Thus, the difference between the first embodiment and the fifth embodiment is mainly described below.

Figure 9:
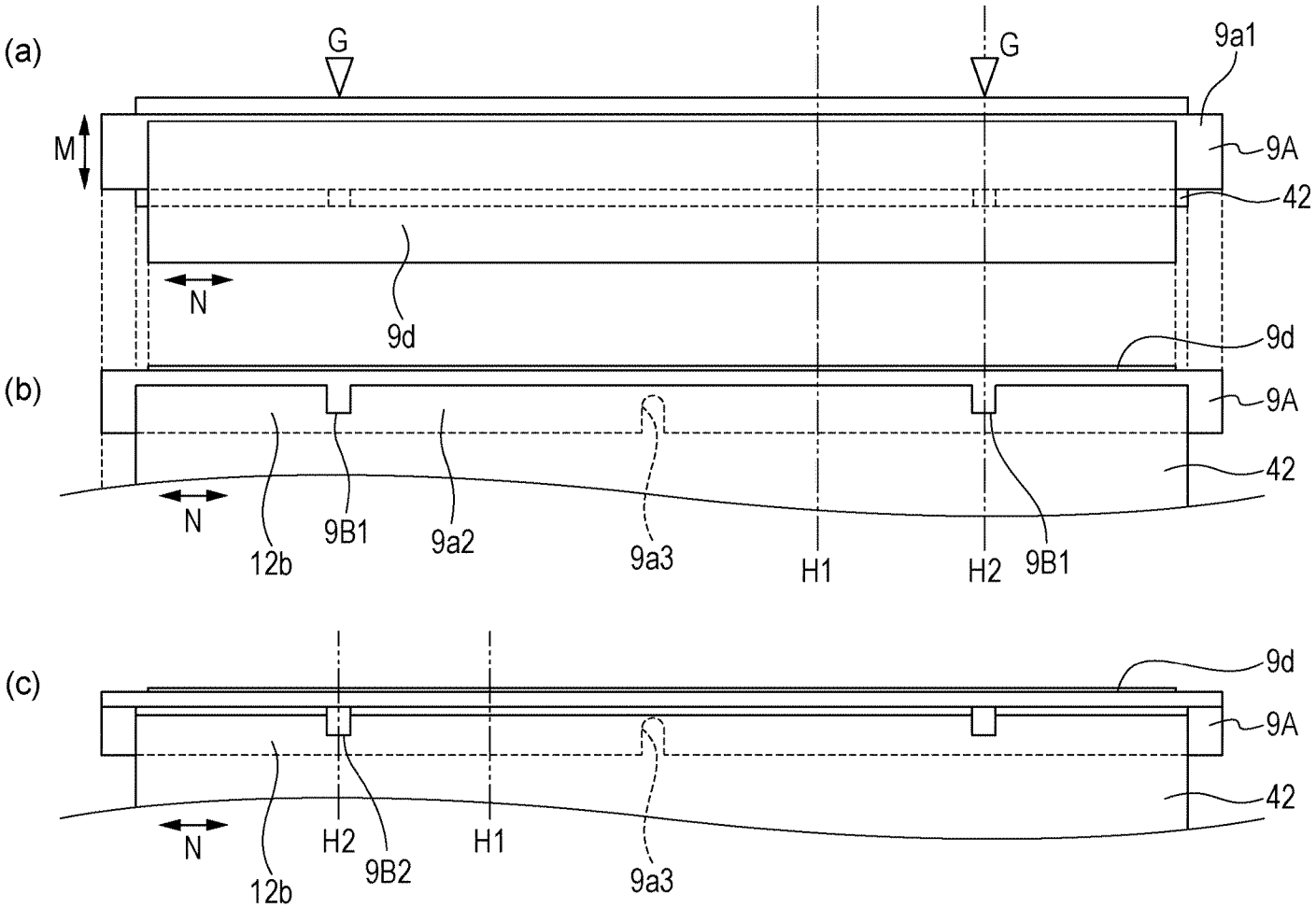
FIG. 9 is a plan view of a cartridge according to a fifth embodiment.
Figure 10A:
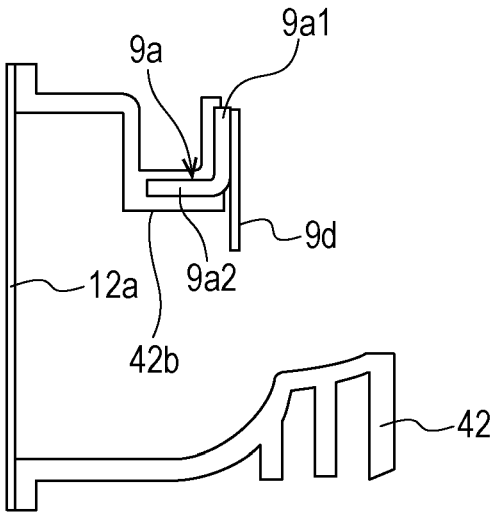
FIG. 10A is a sectional view of the cartridge according to the fifth embodiment.
Figure 10B:
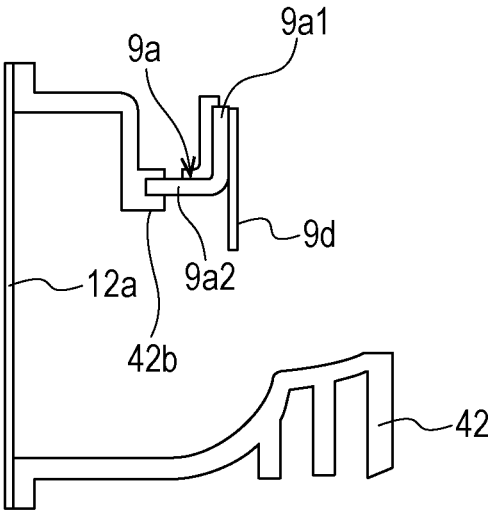
FIG. 10B is a sectional view of the cartridge according to the fifth embodiment.

FIG. 9 includes views (a), (b), and (c) that are respectively a top view, an inner side view, and an outer side view of a developing container 42. FIGS. 10A and 10B are sectional views of the developing container 42 respectively illustrating sections H1 and H2 illustrated in FIGS. 9(*a*), 9(*b*) and 9(*c*). Also according to the present embodiment, as is the case with the first embodiment, the first support member 9*a* having an L-shaped section in the lateral direction M formed by the first plate portion 9*a*1 to which the developing blade 9*d* is secured and the second plate portion 9*a*2 is used. The second plate portion 9*a*2 of the first support member 9*a* is embedded in a securing portion 42*b* of the developing container 42 so as to be secured to the developing container 42, and the developing blade 9*d* is secured to the first plate portion 9*a*1 of the first support member 9*a*. In this state, according to the present embodiment, the developing blade 9*d* is secured to the first plate portion 9*a*1 such that the tip end of the developing blade 9*d* projects toward the side of the first plate portion 9*a*1 connected to the second plate portion 9*a*2. That is, the first support member 9*a* is disposed such that the side of the first plate portion 9*a*1 opposite to the side connected to the second plate portion 9*a*2 faces the outer side of the developing container 42.

More specifically, as illustrated in FIGS. 9(*a*) to 10B, a plurality of exposure portions 9B1 and a plurality of exposure portions 9B2, at which the second plate portion 9*a*2 of the first support member 9*a* are exposed from the developing container 42, are provided. The second plate portion 9*a*2 is exposed from the developing container 42 at the exposure portions 9B1 when seen from a direction facing the tip of the developing blade 9*d*. The exposure portions 9B1 each have a notch shape open to the side of the second plate portion 9*a*2 connected to the first plate portion 9*a*1. The positions of the exposure portions 9B1 and 9B2 are superposed on those of gate portions G, through which the molten resin is injected, in the lateral direction that intersects the longitudinal direction N of the developing container 42.

The second plate portion 9*a*2 is exposed from the developing container 42 at the exposure portions 9B2 when seen from a direction facing the side of the first plate portion 9*a*1 directed to the outer side. The exposure portions 9B2 are through holes that are open toward the outer side.

Other part of the second plate portion 9*a*2 where neither the exposure portions 9B1 nor the exposure portions 9B2 of the developing container 42 are provided in the longitudinal direction are, as illustrated in FIGS. 9(*a*), 9(*b*) and 9(*c*) and FIG. 10B, clamped by the developing container 42 and firmly secured.

Furthermore, as is the case with the first embodiment, the exposed portions 9A are formed so that both the ends of the first support member 9*a* in the longitudinal direction N are exposed from the developing container 42. Furthermore, the notch portion 9*a*3 is provided in the part of the first support member 9*a* embedded in the developing container 42. The resin that forms the developing container 42 has flowed into the notch portion 9*a*3.

A Method of Producing the Developing Unit 2

Figure 11:
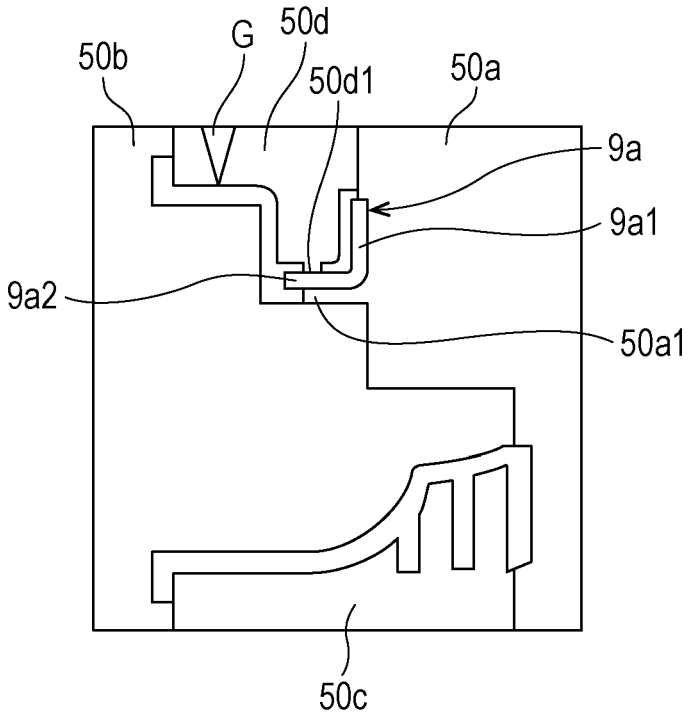
FIG. 11 illustrates a method of producing the cartridge according to the fifth embodiment.

A method of producing the above-described developing container 42 is described below with reference to FIG. 11. The production method is described with an example of a method of forming in which the developing container 42 is integrally molded with the first support member 9*a* by using a mold that includes a fixed part 50*a* and movable parts 50*b*, 50*c*, and 50*d*.

Initially, the first support member 9*a* is prepared and secured to the fixed part 50*a*. Then, the movable parts 50*b*, 50*c* and 50*d* are set in the fixed part 50*a*, and molten resin used to form the developing container 42 is injected into a space having been formed. Thus, the developing container 42 is formed. More specifically, when the first support member 9*a* is set in the mold, the first support member 9*a* is supported by, for example, magnetic attraction or air suction so that the first plate portion 9*a*1 of the first support member 9*a* is brought into contact with and supported by first receiving portions 50*a*1 of the mold 50. Next, the movable parts 50*b*, 50*c*, and 50*d* are set in the fixed part 50*a* so as to be in contact with the fixed part 50*a*, thereby forming the space in the mold. At this time, the first support member 9*a* is also supported by the first receiving portions

50*a*1 of the fixed part 50*a* and second receiving portions 50*d*1 of the movable part 50*d* so that the first support member 9*a* is clamped between the first receiving portions 50*a*1 and the second receiving portions 50*d*1.

Then, the molten resin is injected into the space of the mold through a gate portion G provided in the movable part 50*d* with the first support member 9*a* set in (inserted into) the mold. The molten resin injected through the gate portion G reaches various parts in the mold at different times in accordance with the distances from the gate portion G. The distance between the gate portion G and the first support member 9*a* is the shortest in a section that intersects the longitudinal direction N of the first support member 9*a* (developing container 42). Thus, the position of the first support member 9*a* may be deviated by the molten resin flowing first to the first support member 9*a* corresponding to the position in the lateral direction of the gate portion G.

However, according to the present embodiment, injection molding can be performed while the first support member 9*a* is supported by the first receiving portions 50*a*1 of the fixed part 50*a* and the second receiving portions 50*d*1 of the movable part 50*d* in the section that intersects the longitudinal direction of the first support member 9*a* (developing container 42).

After the resin has been injected, the developing container 42 into which the first support member 9*a* has been inserted is released from the mold. The parts supported by the first receiving portions 50*a*1 and the second receiving portions 50*d*1 respectively become the exposure portions 9B1 and 9B2 at which the first support member 9*a* is exposed.

Effect 5

With the structure according to the above-described embodiment, the pressure applied to the first support member 9*a* by the molten resin injected through the gate portion G can be supported by the first receiving portions 50*a*1 and the second receiving portions 50*d*1. As a result, by efficiently performing insert molding, the first support member 9*a* can be firmly secured while embedded in the developing container 42 with improved positional accuracy realized by suppressing positional deviation. By stably supporting the support member in the mold during injection of the resin as described above, variation in injection of the resin during molding can also be suppressed and stable formability can be realized. In addition, the blade secured to the support member can be attached with good accuracy.

The widths of the exposure portions 9B1 in the longitudinal directions are the same, and widths of the exposure portions 9B2 in the longitudinal direction N are the same. The shape of each of the exposure portions 9B1 is symmetric about a center line of a corresponding one of the gate portions G at the center of the gate portion G in the longitudinal direction N, and the shape of each of the exposure portions 9B2 are symmetric about a center line of a corresponding one of the gate portions G at the center of the gate portion G in the longitudinal direction N. However, the exposed portions 9B1 and 9B2 are not limited to these. It is sufficient that the exposure portions 9B1 and 9B2 be superposed on the respective gate portions G in the sections that intersect the longitudinal direction N. The exposure portions 9B1 are not necessarily symmetric about a center line of the second plate portion 9*a*2 at the center of the second plate portion 9*a*2 in the longitudinal direction N, and the exposure portions 9B2 are not necessarily symmetric about a center line of the second plate portion 9*a*2 at the center of the second plate portion 9*a*2 in the longitudinal direction N.

Although the exposure portions 9B1 and 9B2 are partially provided according to the above-described embodiment, this in not limiting. Specifically, according to the above-described embodiment, the exposure portions 9B1 and 9B2 are provided so as to correspond to the positions of the gate portions G in the lateral direction in the sections that intersect the longitudinal direction N of the first support member 9*a* (developing container 42). However, the exposure portions 9B1 and 9B2 may be provided such that the first support member 9*a* is exposed through the longitudinal direction N with ends of the second plate portion 9*a*2 of the first support member 9*a* secured to the developing container 42. Alternatively, depending on the shape of the mold, one of surfaces of the first plate portion 9*a*1 of the first support member 9*a* may be supported by magnetic attraction, air suction, or the like and the other surface of the first plate portion 9*a*1 may be pressed against the receiving portions provided in the mold. In this case, at least one of the surfaces of the first plate portion 9*a*1 may be exposed through an exposed portion or exposed portions.

Sixth Embodiment

According to the fifth embodiment, the exposure portions 9B1 and 9B2 correspond to the positions of the gate portions G. However, the structures and positions of the exposure portions are not limited to this. Hereafter, the structure of a sixth embodiment is described mainly by describing the differences between the sixth embodiment and first and fifth embodiments. The structure according to the sixth embodiment is also similar to the entire structure of the image forming apparatus and the outline of the entirety of the cartridge of the first embodiment.

In the case where the first support member 9*a* is insert molded, a developing container 52 may be bent after the developing container 52 has been molded. Thus, a structure that suppresses such bending is described.

Initially, how such bending occurs is described. In general, shrinkage referred to as mold shrinkage occurs in resin molded components (components molded by, for example, injection molding) such as a developing container immediately after the molding has been performed. At this time, by a shrinkage force of the resin around the first support member 9*a*, adhesion between the developing container formed of the resin and the first support member increases. Thus, slipping at an interface between the developing container and the first support member is obstructed. As a result, when the difference in linear expansion (thermal expansion) between the first support member 9*a* formed of metal and the developing container 52 formed of resin is large, the cartridge B is deformed by accumulated stress.

In order to address this, exposure portions are provided so as to reduce the widths of respective contact portions where the first support member 9*a* and the developing container 52 are in contact with each other in the longitudinal direction N of the first support member 9*a*, so that stress accumulated in the first support member 9*a* and the developing container 52 is reduced. As a result, stress caused by the difference in linear expansion (thermal expansion) between the first support member formed of metal and the developing container formed of resin can be reduced in the exposure portions, and accordingly, the deformation of the cartridge B can be suppressed.

Figure 12:
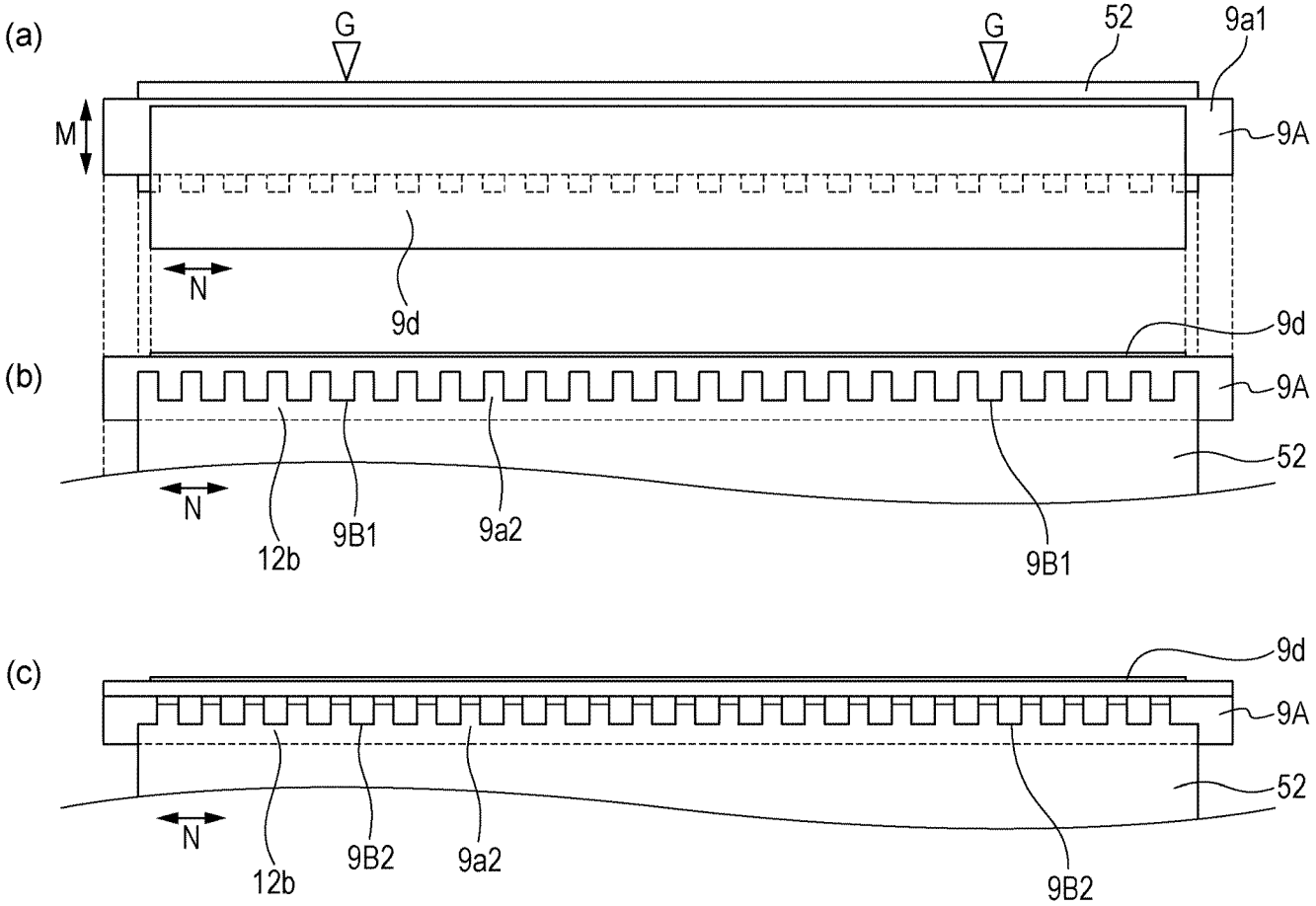
FIG. 12 is a plan view of a cartridge according to a sixth embodiment.

Specifically, exposure portions 9B1 and exposure portions 9B2 are respectively provided in an outer side surface (view (b) of FIG. 12) and an inner side surface (view (c) of FIG. 12) of the second securing portion 12*b* of the developing container 52, which supports the first support member 9*a*, such that the row of the exposure portions 9B1 and the row of the exposure portions 9B2 are staggered with respect to each other in the longitudinal direction N. That is, in sections in directions that intersect the longitudinal direction N of the developing container 52, the first support member 9*a* is not clamped by the resin of the developing container 52. This can reduce the adhesion between the developing container 52 and the first support member 9*a*. In addition, a plurality of the exposure portions 9B1 and a plurality of the exposure portions 9B2 are provided in the longitudinal direction N in the outer side surface and the inner side surface of the second securing portion 12*b* of the developing container 52, respectively. Thus, the stress can be further reduced.

Figure 13:
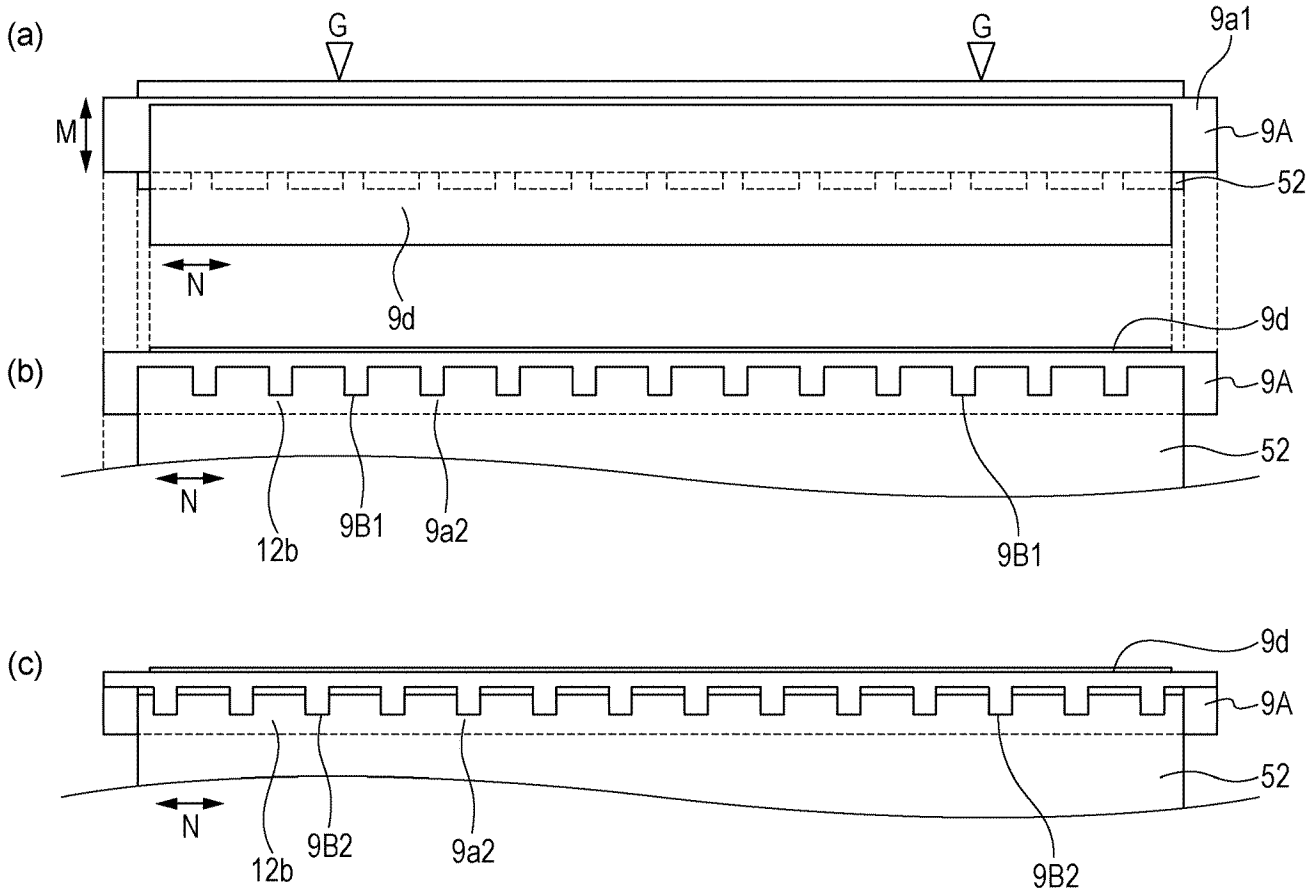
FIG. 13 is a plan view of another structure of the cartridge according to the sixth embodiment.
Figure 14:
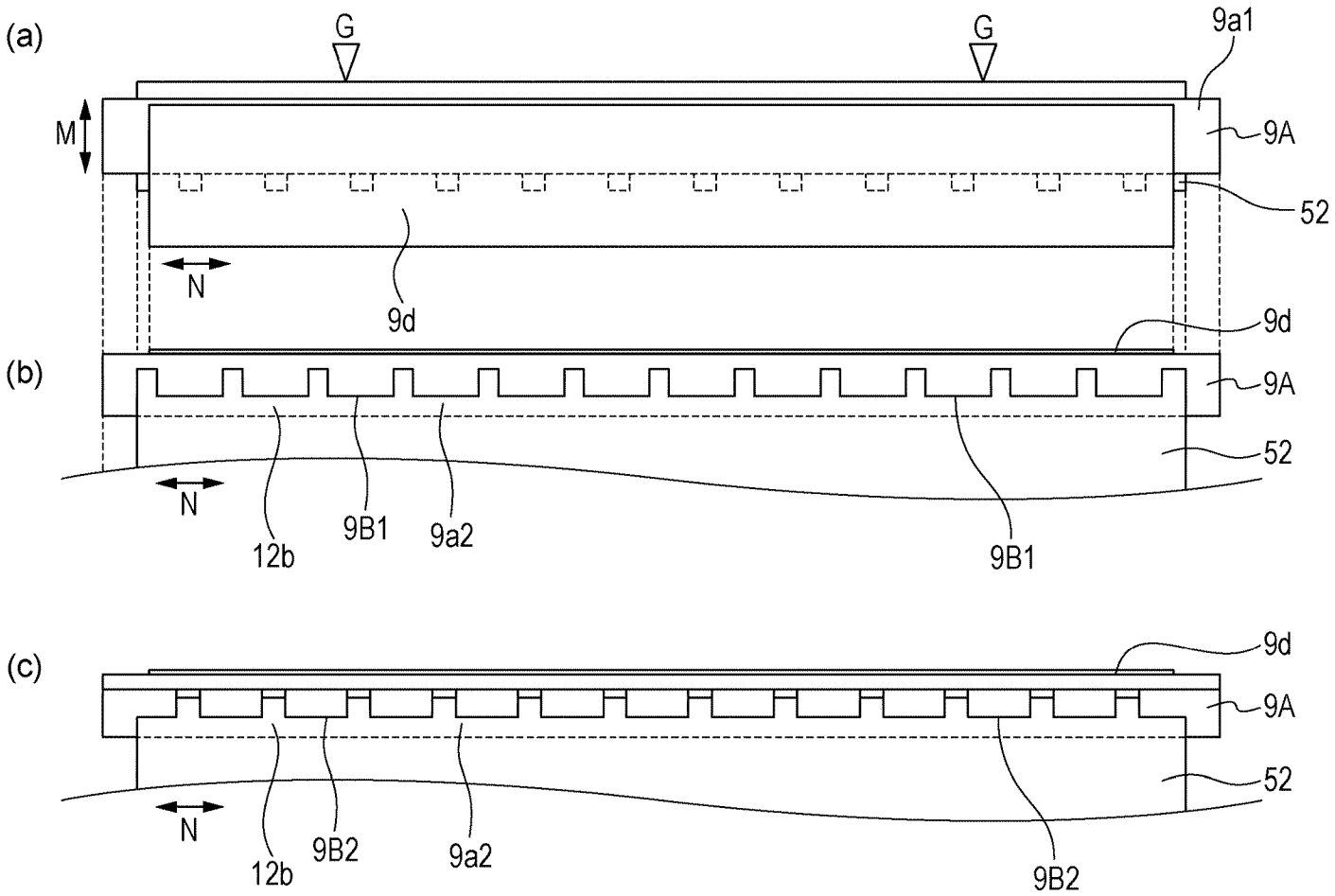
FIG. 14 is a plan view of another structure of the cartridge according to the sixth embodiment.

According to the sixth embodiment, the exposure portions 9B1 and the exposure portions 9B2 are respectively provided in the outer side surface and the inner side surface of the second securing portion 12*b*, which supports the first support member 9*a*, such that the row of the exposure portions 9B1 and the row of the exposure portions 9B2 are staggered with respect to each other in the longitudinal direction N. However, this is not limiting. For example, as long as the amount of bending is tolerable, as illustrated in FIGS. 13(*a*), 13(*b*) and 13(*c*), the exposure portions 9B1 and 9B2 are not necessarily superposed on each other in the longitudinal direction N, and the first support member 9*a* may clamped between the outer side surface and the inner side surface of the second securing portion 12*b* at specified intervals. Alternatively, as illustrated in FIGS. 14(*a*), 14(*b*) and 14(*c*), the exposure portions 9B1 and the exposure portions 9B2 for the first support member 9*a* may be superposed on one another in the longitudinal direction N so as to further reduce the stress.

According to the sixth embodiment, the ratio of exposure of the first support member 9*a* from the developing container 52 to a width of an opening for developing in the longitudinal direction N is about 50%. However, as long as the amount of bending is tolerable, the ratio of exposure from the developing container 52 may be 50% or less. In contrast, when there is no concern over reduction in stiffness of the developing container 52 or dropping of the first support member 9*a*, the ratio of exposure of the first support member 9*a* from the developing container 52 may be 50% or more.

Although the developing blade 9*d* is directly secured to the first support member 9*a* according to the above-described embodiments, this is not limiting. For example, the first support member 9*a* may be disposed as a reinforcing member in the resin that forms the developing container 52, and the developing blade 9*d* may be secured to the developing container 52.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-124748, filed Jun. 17, 2014, and No. 2015-095772, filed May 8, 2015, which are hereby incorporated by reference herein in their entirety.

REFERENCE SIGNS LIST

7 photosensitive drum
8 charging roller
9*a* first support member
9*c* developing roller
9*d* developing blade
10*a* cleaning blade
9*a*3 notch portion
9A exposed portion
10*c* second support member
11 toner container
12, 42, 52 developing container
13 cleaning container
13*a* waste toner chamber
13*b* anti-leakage sheet
A main body of image forming apparatus
B cartridge
C cleaning unit
D developing unit
G gate portion
T developer unit
L laser light

The invention claimed is:

1. A cartridge comprising:

a rotating member;

a blade that extends in a rotating axial direction of the rotating member, one end portion of the blade, in a crossing direction which crosses the rotating axial direction, being in contact with or being disposed close to a surface of the rotating member;

a support member extending in the rotating axial direction, configured to support the other end portion of the blade in the crossing direction; and a frame body formed integrally with the support member by insert molding in which resin is injected while the support member is secured to a mold, configured to clamp the support member, wherein linear expansion coefficient of the support member is different from that of the frame body, and wherein the frame body is configured not to regulate thermal expansion and contraction of the support member in the rotating axial direction.

2. The cartridge according to claim 1, wherein the support member has at least one notch portion, and wherein the frame body is formed by the insert molding so that a part of the frame body is engaged with the at least one notch portion to position the support member relative to the frame body in the rotating axial direction.

3. The cartridge according to claim 2, wherein the at least one notch portion includes a plurality of notch portions arranged at intervals in the rotating axial direction, and a length of each of the intervals is less than half a length of the support member in the rotating axial direction.

4. The cartridge according to claim 1, wherein the frame body supports the support member such that one end portion of the support member in the rotating axial direction is exposed from the frame body.

5. The cartridge according to claim 4, wherein the support member has at least one notch portion, wherein, in the support member disposed in the frame body, an interval between another end portion of the support member and the at least one notch portion in the rotating axial direction of the support member is less than half a length of the support member in the rotating axial direction, and wherein the resin that forms the frame body is formed so as to be engaged with the at least one notch portion, so that the at least one notch portion is positioned relative to the frame body in the rotating axial direction.

6. The cartridge according to claim 4, wherein the support member has a plurality of notch portions arranged at intervals in the rotating axial direction, and wherein a length of each of the intervals is less than half a length of the support member in the rotating axial direction.

7. The cartridge according to claim 1, wherein the support member is longer than the frame body in the rotating axial direction, and a longitudinal end of the support member is arranged outside a longitudinal end of the frame body in the rotating axial direction.

8. The cartridge according to claim 1, wherein the support member is formed of a bent metal sheet that extends in the rotating axial direction.

9. The cartridge according to claim 1, wherein the frame body has a plurality of first contact portions and at least one first exposure portion in one surface of the frame body that extends in the rotating axial direction, wherein the support member is exposed through the at least one first exposure portion, and wherein the frame body and the support member are in contact with each other at the plurality of first contact portions with the at least one first exposure portion interposed therebetween.

10. The cartridge according to claim 9, wherein the at least one first exposure portion includes a plurality of first exposure portions.

11. The cartridge according to claim 9, wherein the frame body has a gate portion or gate portions through which the resin is injected, and wherein the at least one first exposure portion or the plurality of first exposure portions are provided in a section or sections that intersect the rotating axial direction at a part or parts where the gate portion or the gate portions are provided.

12. The cartridge according to claim 9, wherein the frame body has a plurality of second contact portions and at least one second exposure portion in another surface of the frame body that extends in the rotating axial direction, wherein the support member is exposed through the at least one second exposure portion, and wherein the frame body and the support member are in contact with each other at the plurality of second contact portions with the at least one second exposure portion interposed therebetween.

13. The cartridge according to claim 12, wherein the at least one second exposure portion includes a plurality of second exposure portions.

14. The cartridge according to claim 12, wherein the at least one first exposure portion or the plurality of first exposure portions are provided together with the at least one second exposure portion or the plurality of second exposure portions in a section or sections that intersect the rotating axial direction.

15. The cartridge according to claim 1, wherein a bearing member that supports the rotating member is secured to the frame body.

16. The cartridge according to claim 1, wherein the frame body has a bearing portion that supports the rotating member.

17. The cartridge according to claim 1, wherein the rotating member is a photosensitive drum, and wherein the blade is a cleaning blade that removes developer from a surface of the photosensitive drum.

18. The cartridge according to claim 1, wherein the rotating member is a developer bearing member, and wherein the blade is a developing blade that regulates a thickness of the developer borne by the developer bearing member.

19. A frame unit used in a cartridge attachable to and detachable from an image forming apparatus, comprising:

a metal plate; and a frame body formed integrally with the metal plate by insert molding in which resin is injected while the metal plate is secured to a mold, wherein the frame body is configured not to regulate thermal expansion and contraction of a support member in the longitudinal direction of the metal plate.

20. A cartridge comprising:

a rotating member;

a blade extending in a rotating axial direction of the rotating member, one end portion of the blade, in a crossing direction that crosses the rotating axial direction, contacting or being disposed close to a surface of the rotating member;

a support member extending in the rotating axial direction, configured to support the other end portion of the blade in the crossing direction; and a frame body formed integrally with the support member by insert molding in which resin is injected while the support member is secured to a mold, configured to clamp the support member, wherein the support member is positioned, in the rotating axial direction, with respect to the frame body by only one engagement between the frame body and a part of the support member except for both longitudinal end surfaces of the support member.

21. The cartridge according to claim 20, wherein both the longitudinal end surfaces of the support member are exposed outside.

* * * * *